United States Patent [19]

Carpenter

[11] 3,936,174

[45] Feb. 3, 1976

[54] TRANSFER ROLLER WITH STATIONARY INTERNAL ELECTRODE

[75] Inventor: Charles E. Carpenter, Rochester, N.Y.

[73] Assignee: Xerox Corporation, Stamford, Conn.

[22] Filed: Jan. 27, 1975

[21] Appl. No.: 544,156

[52] U.S. Cl. ..... 355/3 R; 317/262 A; 96/1.4

[51] Int. Cl.[2] ..... G03G 15/00

[58] Field of Search ..... 355/3 TR, 3 R; 317/262 A; 96/1.4

[56] References Cited

UNITED STATES PATENTS 3,830,589 8/1974 Allen ..... 355/3 TR 3,847,478 11/1974 Young ..... 355/3 TR

*Primary Examiner*—R. N. Envall, Jr.

[57] ABSTRACT

A biased roller electrostatographic image transfer system in which concentrated and tailored image transfer fields are generated by stationary electrically biased conductive electrodes inside the roller having blade-like edges extending toward the nip and post-nip areas, in which the transfer fields are applied from the blade-like edges through a thin-walled rotatable outer tube providing the roller nip.

7 Claims, 2 Drawing Figures

TRANSFER ROLLER WITH STATIONARY INTERNAL ELECTRODE

Figure 1:
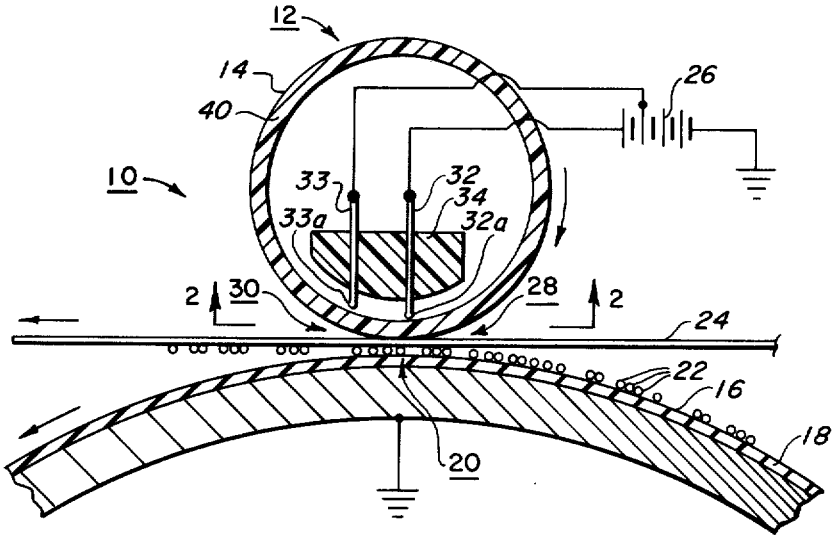

The present invention relates to a biased roller image transfer system in electrostatography in which the transfer fields are tailored by a stationary conductive shaped electrode inside the roller.

In a conventional transfer station in electrostatography, toner (image developer material) is transferred from the photoreceptor (the original support and imaging surface) to the copy sheet (the final support surface or transfer member). The toner is then fixed to the copy sheet, typically in a subsequent thermal fusing station.

In xerography, this transfer is most commonly achieved by electrostatic force fields created by D.C. charges applied to or adjacent the back of the copy sheet while the front side of the copy sheet contacts the toner-bearing photoreceptor surface. The transfer field must be sufficient to overcome the forces holding the toner onto the photoreceptor and to attract the toner over onto the copy sheet. These transfer fields are generally provided in one of two ways: by ion emission from a transfer corotron onto the copy paper, as in U.S. Pat. No. 2,807,233; or by a D.C. biased transfer roller or belt rolling along the back of the paper, and holding it against the photoreceptor.

The present invention relates to bias roller transfer systems. Some general examples are described in U.S. Pat. Nos. 2,807,233; 3,043,684; 3,267,840; 3,328,193; 3,598,580; 3,625,146; 3,630,591; 3,684,364; 3,691,993; 3,702,482; 3,781,105; 3,832,055; and 3,847,478.

U.S. Pat. No. 3,830,589 discloses a fixed transfer block containing spaced and variably biased conductive bars integrally molded in a resistive material for providing tailored image transfer fields. U.S. Pat. No. 3,647,292 also discloses multiple conductor transfer members associated with a copy transport belt. U.S. Pat. No. 3,832,055 listed above discusses transfer rollers containing multiple biased conductors which rotate with the roller.

It is well known to use highly electrically biased stationary conductive needles, brushes or blades to deposit charges on surfaces in xerography, e.g., U.S. Pat. Nos. 3,146,385 and 3,649,830. However, this art also teaches that highly charged points or edges conventionally provide corona ion generation, which is not desirable in the present system.

The difficulties of successful electrostatographic image transfer are well known. In the pre-transfer (pre-nip) region or area, before the copy paper contacts the image, if the transfer fields are high the toner image is susceptible to premature transfer across too great an air gap, leading to decreased image resoltuion and, in general, to fuzzy images. Further, if there is pre-nip ionization, it may lead to strobing defects, loss of transfer efficiency, or "splotchy" transfer and a lower latitude of acceptable system operation. In the post-nip region, at the photoconductor-paper separation area, if the transfer fields are too low (e.g., less than approximately 12 volts per micron for lines and 6 volts per micron for solid areas) hollow characters may be generated, especially with smooth papers, high toner pile heights and high nip pressures (greater than approximately 0.07 kg per square cm). If the fields in certain portions of the post-nip region are otherwise improper, the resulting ionization may cause image instability and paper detaching. On the other hand, in the nip region itself, to achieve high transfer efficiency and avoid retransfer, the transfer field should be as great as possible (greater than approximately 20 volts per micron). To ahcieve these desired different and non-symmetrical fields in these adjacent regions consistently and with appropriate transitions is difficult, especially where the air gaps are defined by the symmetrical geometry of a cylindrical roller.

The transfer system of the invention is intended to overcome many of these problems with a simple transfer roller structure. It may be utilized for transfer with an imaging surface of any desired configuration, such as a cylinder or a belt. It may also be used for transfer to an intermediate surface rather than a final copy surface, and for duplex as well as simplex transfer systems.

The above-cited and other references teach details of various suitable exemplary xerographic or other electrostatographic structures, materials, systems and functions known to those skilled in the art, and are incorporated by reference in this specification, where appropriate. Accordingly, the following description is confined to the novel aspects of the present invention.

Figure 2:
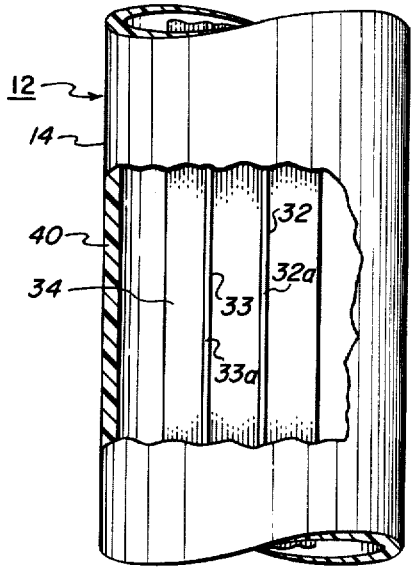

Further objects, features and advantages of the present invention pertain to the particular apparatus and details whereby the above-mentioned aspects of the invention are attained. Accordingly, the invention will be better understood by reference to the following description of one example thereof, and to the drawings forming a part of the description, which are substantially to scale, wherein:

FIG. 1 is an axial cross-sectional view of an exemplary biased roller transfer system in accordance with the present invention; and FIG. 2 is a bottom view of the transfer roller of FIG. 1, with its tubular roller member partially broken away to more clearly illustrate its internal construction.

Referring to FIGS. 1 and 2, there is shown therein the transfer station of an exemplary electrostatographic copying system 10 comprising a cylindrical transfer roller member 12 providing an example of the present invention. The cylindrical outer surface 14 of the transfer member 12 engages the imaging surface 16 of a conventional photoreceptor 18 to define a transfer nip 20. In the transfer nip 20, toner particles 22 are transferred from the imaging surface 16 to the facing surface of a copy sheet 24 passing through the transfer nip 20. The copy sheet 24 is held against the imaging surface 16 by the transfer member 12 and transfer is effected by electrical transfer fields generated between the transfer member 12 and the imaging surface 16. These transfer fields are generated by applying an electrical bias from a bias voltage source 26 to the transfer member 12, and by providing a grounded substrate for the photoreceptor 18. It will be appreciated that an image-wise pattern of the toner 22 is formed on the imaging surface 16 by suitable conventional electrostatographic processes prior to its entry into the surface station.

It may be seen that upstream of the transfer nip 20 there is a pre-transfer area 28 in which there is an air gap between the outer surface 14 of the transfer member 12 and the imaging surface 16. In the pre-transfer region 28 there is also an air gap between the copy sheet 24 and the imaging surface 16 as it moves into engagement therewith. Correspondingly, there is a post-transfer area 30 downstream of the transfer nip

20.

It may be seen that the transfer member 12 here differs from a conventional bias transfer roller in that there are two stationary conductive transfer electrodes 32 and 33 inside the transfer roller with relatively thin blade-like edges 32*a* and 33*a*. The electrodes 32 and 33 are mounted on an insulative block 34. The block 34 is stationarily mounted inside a tubular member 40, which is the only rotating portion of the transfer member 12. The tubular member 40 provides the outer surface 14 of the transfer roller 12 and the transfer nip.

Controlled, tailored and localized transfer fields are applied in the transfer nip and post-nip regions by means of the two biased electrodes 32 and 33 from their edges 32*a* and 33*a*. The two electrodes are electrically insulated from one another by the block 34 and separately connected to the bias power supply 26 so that the electrode 33 in the post-nip area 30 has a lower applied bias voltage than the electrode 32 in the nip area 20. It may be seen that the two electrodes are generally parallel spaced apart, as are their edges 32*a* and 33*a*. The edges 32*a* and 33*a* are preferably smooth or rounded against irregularities or sharp surfaces which could otherwise cause corona generation sites due to the relatively high bias voltages applied to the electrodes. These edges extend axially linearly inside the roller 12, uniformly closely approaching the interior surface of the tubular member 40 and facing toward the imaging surface 16 in the nip and post-nip regions to provide concentrated electrical fields in these regions adjacent the blade edges through the wall of tubular member 40. The entire electrodes 32 and 33 may be formed from single sheet metal segments molded or otherwise secured into the insulative block 34.

By this arrangement, the desired high intensity transfer fields can be provided in the nip region 20 as well as in the post-nip region 30 while simultaneously preventing undesirable high pre-nip region 28 field intensities. Low pre-nip fields are provided without requiring any reduction in the bias potential applied to the transfer electrode or any increase in its spacing from the image support surface 16, and therefore without any sacrifice in transfer efficiency.

It will be appreciated that an increase in the spacing between the edges 32*a* and 33*a* of the biased electrodes and the opposing grounded substrate of the photoreceptor 18 will cause a corresponding reduction in the transfer field for the same applied bias voltage 26. This is minimized here by maintaining the wall thickness of the tubular roller 40 relatively thin, consistent with mechanical strength requirements, and also by extending the edges 32*a* and 33*a* to closely adjacent or directly against the interior surface of the tube 40. If the insulative block 34 and the electrodes 32 and 33 are mounted independently of the tubular member 40 they can be held at a fixed distance from the imaging surface 16, irrespective of slight movements of the roller 40 due to differences in thickness of different copy sheets 24 passing through the nip 20. However, spacing of the blade edges 32*a* and 33*a* as closely as possible to the roll interior is preferred in order to reduce the possibility or amount of air ionization. The blade edges 32*a* and 33*a* can be allowed to actually contact the slide against the inside of the tube 40. In that case there is no difference in the spacing therebetween due to runout tolerances in the roll interior. In either case, a grounding brush, A.C. corotron or other charge neutralizing device can be provided operating against the interior of the tubular member 40 away from the electrodes 32 and 33 to neutralize residual charges placed on the interior of the member 40 by either air ionization or direct contact from the electrodes. In the event that it is desired to have the electrode extremities 32*a* and 33*a* in sliding contact with the interior of the tube 40, a lubricating material layer can be applied to the interior of the tube 40, if desired.

With the arrangement described herein, the material of the tubular cylinder 40 does not need to be an electrically relaxable material as taught, for example, in the above-cited U.S. Pat. No. 3,781,105. Various conventional fully or substantially non-conductive plastic or rubber materials can be utilized, and are preferred. A fairly low dielectric constant is desirable, but not critical. The wall thickness of the rotating tube 40 should be both thin and uniform so as to not interfere with the applying therethrough of a high and uniform transfer field in the transfer nip 20 between the transfer electrode 32 and the photoreceptor 18 as the tube 40 rotates. Preferably the outer surface 14 should be resilient for good nip formation and uniform copy sheet retention against the photoreceptor, although the roller 40 should be relatively stiff to avoid substantial deformation. A multi-layer roller of different material can be used.

It will be appreciated that the entire roller 12, including all the stationary components, can be pivotally mounted so as to be movable as a unit away from the photoreceptor 18 when not accomplishing transfer as shown in some of the above-cited references. Thus, by stationary or fixed it is meant that the electrodes 32 and 33 do not rotate with the roller 12 and remain in the same relative position with regard to the transfer nip 20 in the direction of the paper path. The electrodes 32 and 33 are biased to different levels from the same bias supply 26. It will be appreciated, however, that they could also be separately biased with a different or even opposing polarity voltage for somewhat different field tailoring.

In their disclosed position completely internal the roller the electrodes 32 and 33 do not create any undesired transfer air gaps between the transfer roller outer surface 14 and the copy sheet 24, and do not create any air gap between the copy sheet 24 and the imaging surface 16. Likewise, they do not prevent the transfer roller from performing its conventional and desired function of holding the copy sheet 24 down directly against the imaging surface 16 for reliable transfer and paper handling. Further, all of the components of the roller 12 to which electrical connections are made here are non-rotating for improved reliability. The actual mechanical roller portion 40 is not electrically biased, rather the transfer field is passed therethrough.

It will be appreciated that charge neutralizing means such as a ground brush or A.C. corona generator may be applied to the rolling tube 40 for surface 14 charge neutralization, if desired. Alternatively the roller element 40 may be a non-critical somewhat semi-conductive relaxable material and the interior thereof grounded (away from the electrodes) to remove charges.

In conclusion, there has been described herein a novel transfer system providing tailored transfer fields with a simple structural arrangement. Numerous modifications and variations thereof will be obvious to those skilled in the art. The following claims are intended to cover all such variations and modifications as fall within the true spirit and scope of the invention.

What is claimed is:

1. In an electrostatographic copying system wherein an image is transferable from a first image support surface to a second image support surface utilizing an electrically biased rotatable transfer roller forming a transfer nip, and adjacent pre and post-nip areas, with said first image support surface for passage of said second image support surface through said transfer nip against said first image support surface for said image transfer, as well as through said pre-nip and post-nip areas, the improvement wherein said transfer roller comprises:

an outer, thin-walled, substantially non-conductive, rotatable, tubular member forming said transfer nip, at least one conductive transfer electrode non-rotatably mounted inside said tubular member, said transfer electrode being electrically biased and providing transfer fields between said transfer electrode and said first image support surface through said tubular member, said transfer electrode having a thin elongated blade-like edge extending in length axially along inside said tubular member, said blade-like edge extending towards said wall of said tubular member and towards said first image support surface to provide concentrated transfer fields between said blade-like edge and said first image support surface.

2. The transfer roller of claim 1, wherein said tubular member has a substantially cylindrical interior surface and said blade-like edge extends to closely adjacent said interior surface.

3. The transfer roller of claim 1, wherein there are at least two of said transfer electrodes and said blade-like edges of each are generally parallel spaced apart.

4. The transfer roller of claim 1, wherein a separate further one of said transfer electrodes inside said tubular member has a further blade-like edge extending towards said post-nip area.

5. The transfer roller of claim 4, wherein said transfer electrodes are electrically discrete and differently electrically biased.

6. The transfer roller of claim 4, wherein said tubular member has a generally cylindrical interior surface, and wherein both said transfer electrodes are commonly mounted in a fixed insulative body spaced inside said tubular member, and wherein said blade-like edges extend from said insulative block to closely adjacent said interior surface of said tubular member.

7. The transfer roller of claim 6, wherein said transfer electrodes are electrically discrete and differently electrically biased.

* * * * *